US007010244B2

(12) United States Patent
Kang et al.

(10) Patent No.: US 7,010,244 B2
(45) Date of Patent: Mar. 7, 2006

(54) COLOR ELECTROPHOTOGRAPHIC PRINTER HAVING PHOTOSENSITIVE DRUM PROTECTION DEVICE AND METHOD OF OPERATING SAME

(75) Inventors: Il-kwon Kang, Suwon-si (KR); Ki-ju Pak, Seongnam-si (KR); Hyo-jin Lee, Yongin-si (KR)

(73) Assignee: Samsung Electronics Co., Ltd., (KR)

( * ) Notice: Subject to any disclaimer, the term of this patent is extended or adjusted under 35 U.S.C. 154(b) by 0 days.

(21) Appl. No.: 10/860,059

(22) Filed: Jun. 4, 2004

(65) Prior Publication Data

US 2005/0019062 A1 Jan. 27, 2005

(30) Foreign Application Priority Data

Jul. 24, 2003 (KR) ..... 10-2003-0051112

(51) Int. Cl.
*G03G 21/18* (2006.01)

(52) U.S. Cl. ..... 399/114; 399/112

(58) Field of Classification Search ..... 399/91, 399/98, 102, 112, 114, 124, 128, 159, 160
See application file for complete search history.

(56) References Cited

U.S. PATENT DOCUMENTS

| | | | | |
|---|---|---|---|---|
| 4,939,548 | A | 7/1990 | Yamada et al. | 355/245 |
| 5,111,245 | A | 5/1992 | DeCecca et al. | 355/245 |
| 5,331,390 | A | 7/1994 | Kimura et al. | 355/326 |
| 5,610,701 | A | 3/1997 | Terada et al. | 399/298 |
| 6,453,135 | B1 * | 9/2002 | Sameshima et al. | 399/110 |
| 2004/0126136 | A1 * | 7/2004 | Toba et al. | 399/114 |

FOREIGN PATENT DOCUMENTS

| | | | |
|---|---|---|---|
| JP | 2001188456 A | * | 7/2001 |
| JP | 2001-277581 | | 10/2001 |

* cited by examiner

*Primary Examiner*—Susan Lee
(74) *Attorney, Agent, or Firm*—Roylance, Abrams, Berdo & Goodman, LLP

(57) ABSTRACT

A photosensitive drum protecting device for use in a color electrophotographic printer is provided. The printer, in which developing device cartridges of various colors including photosensitive drums and developing rollers are installed, and a printing path contacting the photosensitive drums is formed, includes a photosensitive drum protecting device that simultaneously exposes or protects each of the photosensitive drums. All of the photosensitive drums disposed at front end portions of the developing device cartridges are covered by just one photosensitive drum protecting device. Thus, the complexity of the printer is reduced and the printer can be made more compact.

14 Claims, 5 Drawing Sheets

COLOR ELECTROPHOTOGRAPHIC PRINTER HAVING PHOTOSENSITIVE DRUM PROTECTION DEVICE AND METHOD OF OPERATING SAME

BACKGROUND OF THE INVENTION

This application claims the benefit under 35 U.S.C. §119 (a) of Korean Patent Application No. 2003-51112, filed on Jul. 24, 2003, in the Korean Intellectual Property Office, the entire disclosure of which is incorporated herein by reference.

1. Field of the Invention

The present invention relates to an electrophotographic printer. More particularly, the present invention relates to an electrophotographic printer with a simplified structure that facilitates further reduction in the size of the printer.

2. Description of the Related Art

Generally, electrophotographic printers print monochromatic or color images by scanning light onto a photosensitive medium charged to a predetermined potential to form an electrostatic latent image, developing the electrostatic image with toners of predetermined colors using a developer, and transferring and recording the developed image onto a physical recording medium such as a sheet of paper.

Electrophotographic printers can be divided into liquid electrophotographic printers and dry-type electrophotographic printers according to the type of developer. A liquid electrophotographic printer uses a developer in which a powder toner is mixed with a liquid carrier. A dry-type electrophotographic printer uses a two-component developer including a powder carrier and a toner, or a single-component developer including a toner only. Hereinafter, the dry-type electrophotographic printer will be described, and the developer may be referred to as toner.

In order to print a full-color image, different colored toners, such as yellow (Y), magenta (M), cyan (C), and black (K) colors are required. Thus, four developing devices that each develop one of the four color toners are required. To form a full-color image, there is a single path method, in which when a transfer substance passes through photosensitive substances, on which four color images are formed, the color images are sequentially transferred, and there is a multi-path method, in which when the transfer substance passes through the photosensitive substances, the image is transferred from only one photosensitive substance and the process is repeated to form the image. In both methods, the four developing devices are generally required.

When a color image is printed using the multi-path method, the processing time is four times longer than when printing a monochromatic image, however, the structure of the printer is simple. When a color image is printed using the single-path method, the printing time is the same as when printing a monochromatic image, and thus color printing can be performed at a high speed.

FIG. 1 is a cross-section of a conventional electrophotographic image forming apparatus using the single-path method, and FIG. 2 is a cross-section of a developing device of the apparatus shown in FIG. 1.

Referring to FIG. 1, the image forming apparatus includes a light scan unit 20 that scans light onto four photosensitive drums 10, which are charged to a predetermined electric potential, to form an electrostatic latent image, four developing devices 30 that develop the electrostatic latent image with four color toners (Y, M, C, and K) to form toner images on the photosensitive drums 10, a feeding belt 40 that conveys a sheet of paper onto which the toner images of four colors formed on the photosensitive drums 10 are transferred sequentially, and a fuser 50 that fuses the toner image onto the paper by heating and pressing the paper onto which the toner image has been transferred. A paper feeding cassette 60 that feeds the paper (S) is installed to be inserted/removed from a main body of the image forming apparatus. The photosensitive drums 10 are integrally installed on respective developing devices 30, and the developing devices 30 including the photosensitive drums 10 are vertically disposed to perform a color printing operation according to the single-path method. This contributes to making the image forming apparatus compact.

Referring to FIG. 2, which shows one of the developing devices 30 of the apparatus of FIG. 1, the photosensitive drum 10 is integrally installed on the developing device 30. The developing device 30 includes the photosensitive drum 10, a charging roller 31 that charges the photosensitive drum to a predetermined electric potential, a developing roller 32 that develops the electrostatic latent image on the photosensitive drum 10, and a plurality of agitators 33 that mix and supply the toner in the developing device 30 to the developing roller 32. Reference numeral 34 denotes a case of the developing device 30, reference numeral 34*a* denotes an opening through which a laser beam passes to form the electrostatic latent image on the photosensitive drum 10, and reference numeral 35 denotes a cleaning roller for removing toner remaining on the photosensitive drum 10.

The developing device 30 further includes a cover 71 that protects the photosensitive drum 10 from light and dust when the printer is opened to change a photosensitive drum 10 or clear a paper jam. Both ends of the cover 71 are connected to shafts 72, and end portions of the shafts 72 are connected to levers 73. The shaft 72 and the lever 73 are coupled by a hinge 74, and the shaft 72 is connected to an spring 75. Therefore, when the lever 73 rotates in the counterclockwise direction, the shaft 72 and the cover 71 also rotate in the counterclockwise direction to expose some part of the photosensitive drum 10, so that the toner images can be transferred onto the paper placed on a paper feeding path. Also, when the lever 73 is released, the shaft 72 is drawn back to its original position by the spring 75 so that the cover 71 and the lever 73 rotate in the clockwise direction and the cover 71 protects the surface of the photosensitive drum 10.

However, in the color printer using the single-path method, in which the photosensitive drums 10 are vertically arranged using the four developing devices 30 (toner cartridges), a cover unit for protecting the photosensitive drum 10 is required for every toner cartridge. This takes up a lot of space and is a limitation to making the color printer compact.

SUMMARY OF THE INVENTION

Embodiments of the present invention provide a compact color printer including a photosensitive drum protecting device having a simplified structure.

According to an aspect of the present invention, there is provided a color electrophotographic printer, in which developing device cartridges of various colors including photosensitive drums and developing rollers are installed, and a printing path contacting the photosensitive drums is vertically formed, the printer including a photosensitive drum protecting device that simultaneously exposes/protects the photosensitive drums.

The photosensitive drum protecting device may include a photosensitive drum cover including a plurality of elongated openings through which the photosensitive drums are exposed, a first elastic member that supports an upper portion of the photosensitive drum cover, a second elastic member that supports a lower portion of the photosensitive drum cover; and a protrusion that is installed between the photosensitive drum cover and one of the first elastic member or the second elastic member, in order to move the photosensitive drum cover along the printing path due to displacement of the protrusion.

The photosensitive drum cover is fabricated using a flexible film, and may be fabricated using a polycarbonate film.

When the protrusion is moved to a direction, the photosensitive drums may protrude from the elongated openings of the photosensitive drum cover to form a contact portion between the photosensitive drums and the printing path, and when the protrusion is moved to an original position, the photosensitive drum cover may block the contact portion.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
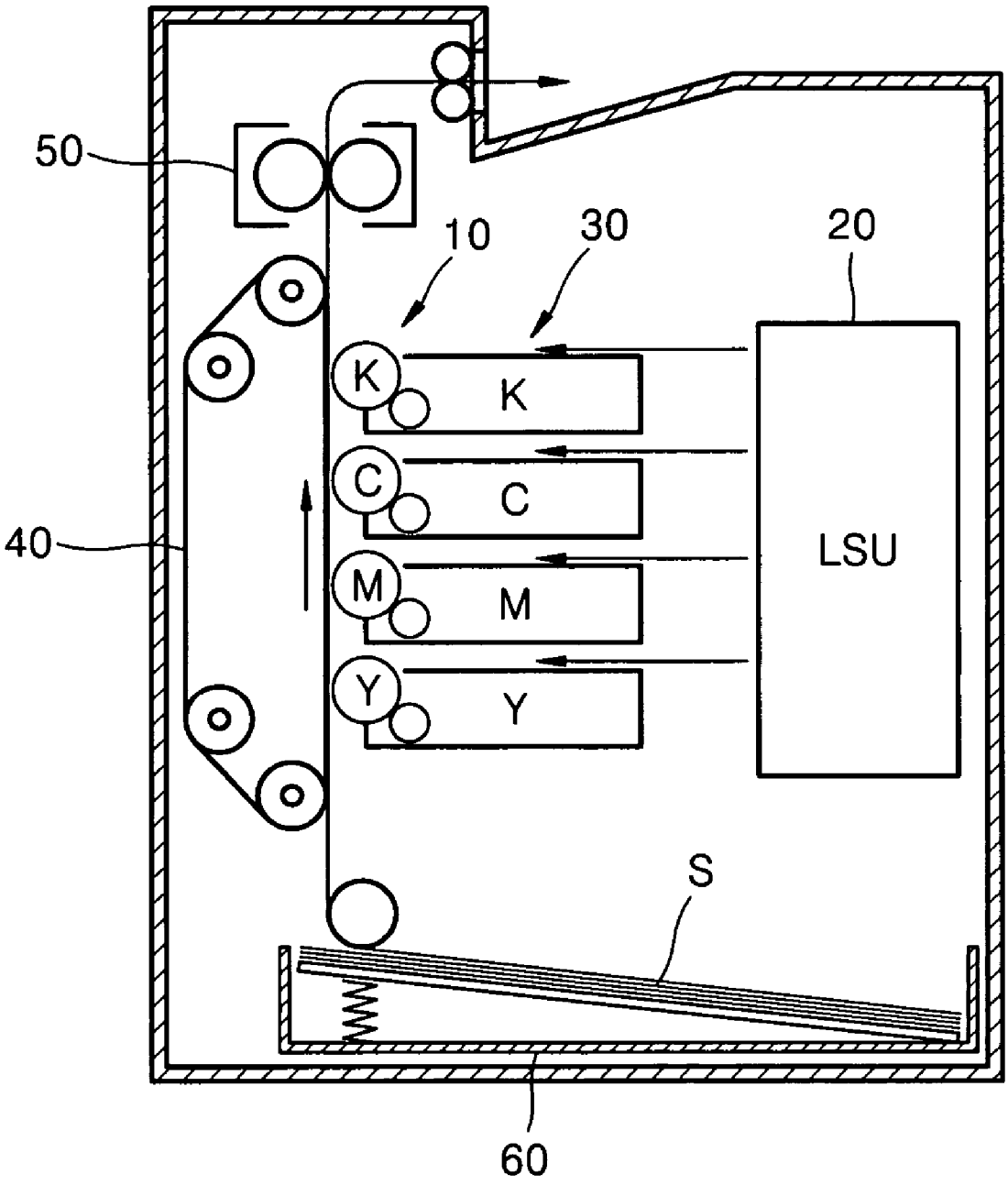
FIG. 1 (PRIOR ART)
FIG. 1 is a cross-sectional view of a conventional color electrophotographic printer using a single-path method.
Figure 2:
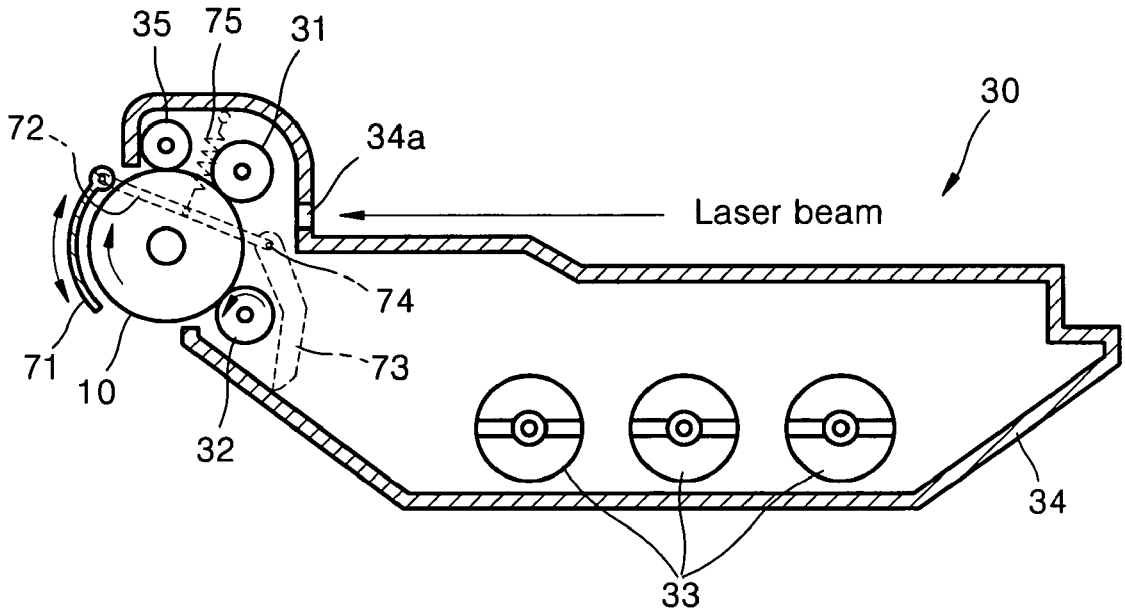
FIG. 2 (PRIOR ART)
FIG. 2 is a cross-sectional view of a developing device of the apparatus shown in FIG. 1.
Figure 3:
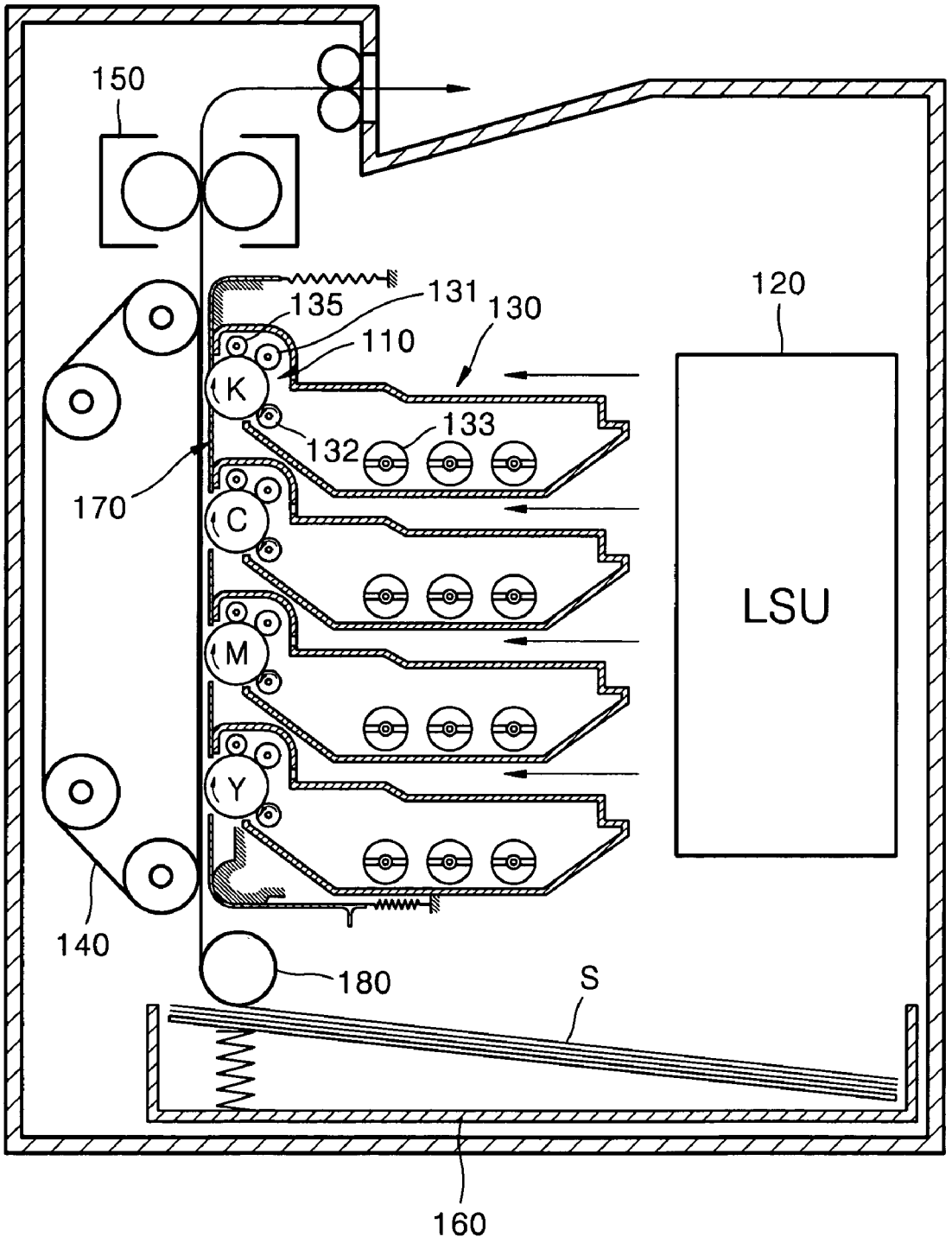
FIG. 3 is a cross-sectional view of a color electrophotographic printer according to an embodiment of the present invention.

FIG. 3 shows a schematic configuration of a color electrophotographic printer according to an embodiment of the present invention.

Referring to FIG. 3, developing device cartridges 130 that include photosensitive drums 110 and develop the photosensitive drums 110 with toners of yellow (Y), magenta (M), cyan (C), and black (K) colors are arranged in a direction perpendicular to a direction of a printing path. The photosensitive drum 110 contacts a sheet of paper on the printing path at a front end portion of each of the developing device cartridges 130. A cleaning roller 135 that removes toner remaining on the drum 110, a charging roller 131 that charges the photosensitive drum 110 to a predetermined electric potential, and a developing roller 132 that develops an electrostatic latent image formed on the surface of the photosensitive drum 110 by a light scanning unit 120 with toners of four colors (Y, M, C, and K) to form a toner image on the photosensitive drum 110 are disposed on each of the photosensitive drums 110. A plurality of agitators 133 are installed inside the developing device cartridge 130 to stir the toner and supply the toner to the developing roller 132.

The light scanning unit 120 is disposed at a rear side of the developing device cartridges 130 to form the electrostatic latent images on the photosensitive drums 110 through openings (refer to 134*a* in FIG. 4) formed in cases (refer to 134 in FIG. 4) of the developing device cartridges 130.

A cassette 160 containing sheets of paper (S), and a pickup roller 180, are disposed under the developing device cartridges 130, and a paper feeding belt 140 is installed at a position facing the photosensitive drums 110 so that a sheet of paper (S) picked up by the pickup roller 180 proceeds along the printing path.

A fuser 150 that heats and presses paper onto which images are transferred by the photosensitive drums 110, to fuse the toner images on the paper, is disposed at a rear-end portion of the paper feeding path.

Figure 4:
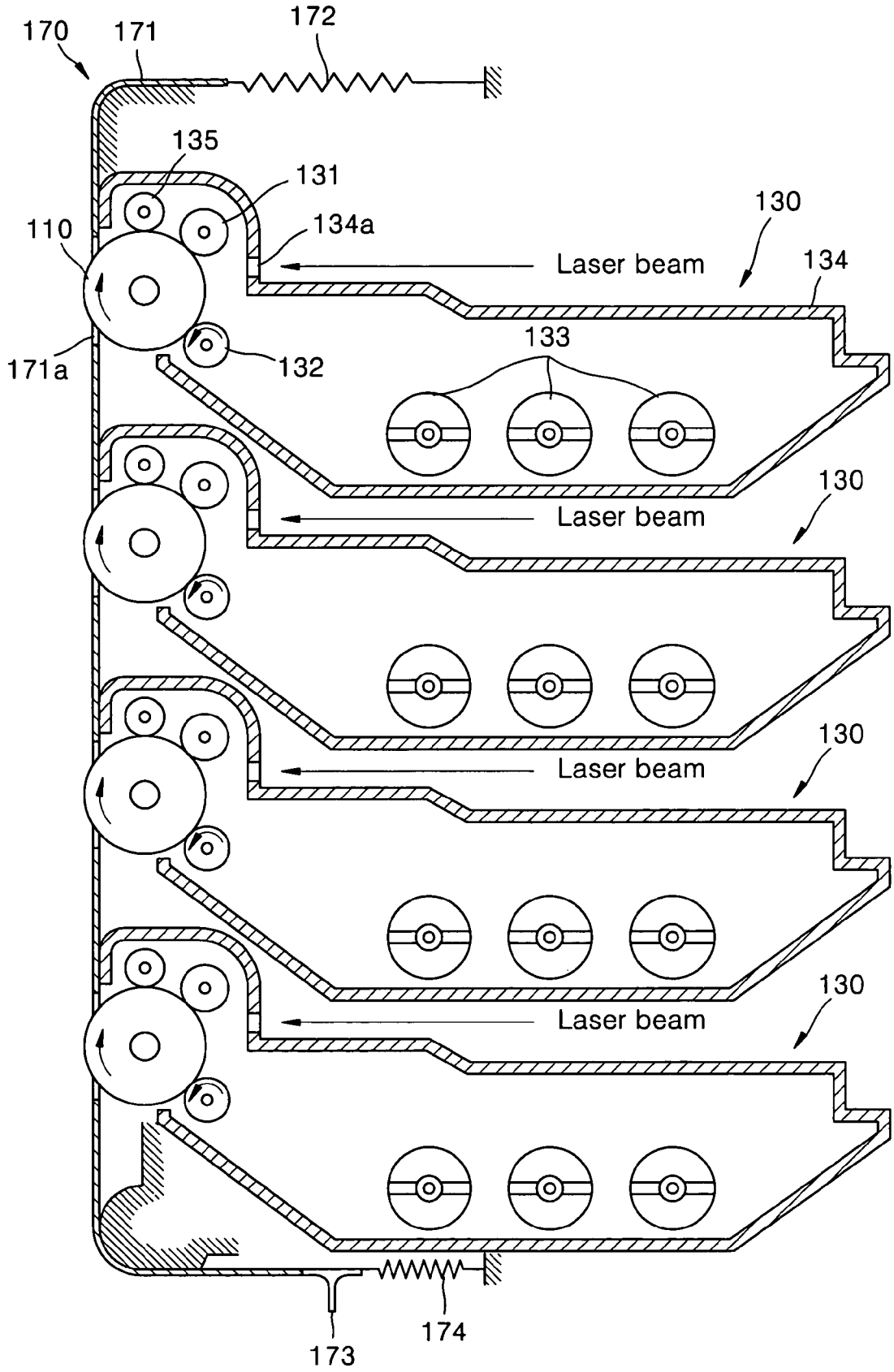
FIG. 4 is a cross-sectional view of developing device cartridges of the apparatus shown in FIG. 3, wherein photosensitive drum protecting devices are in a open state.
Figure 5:
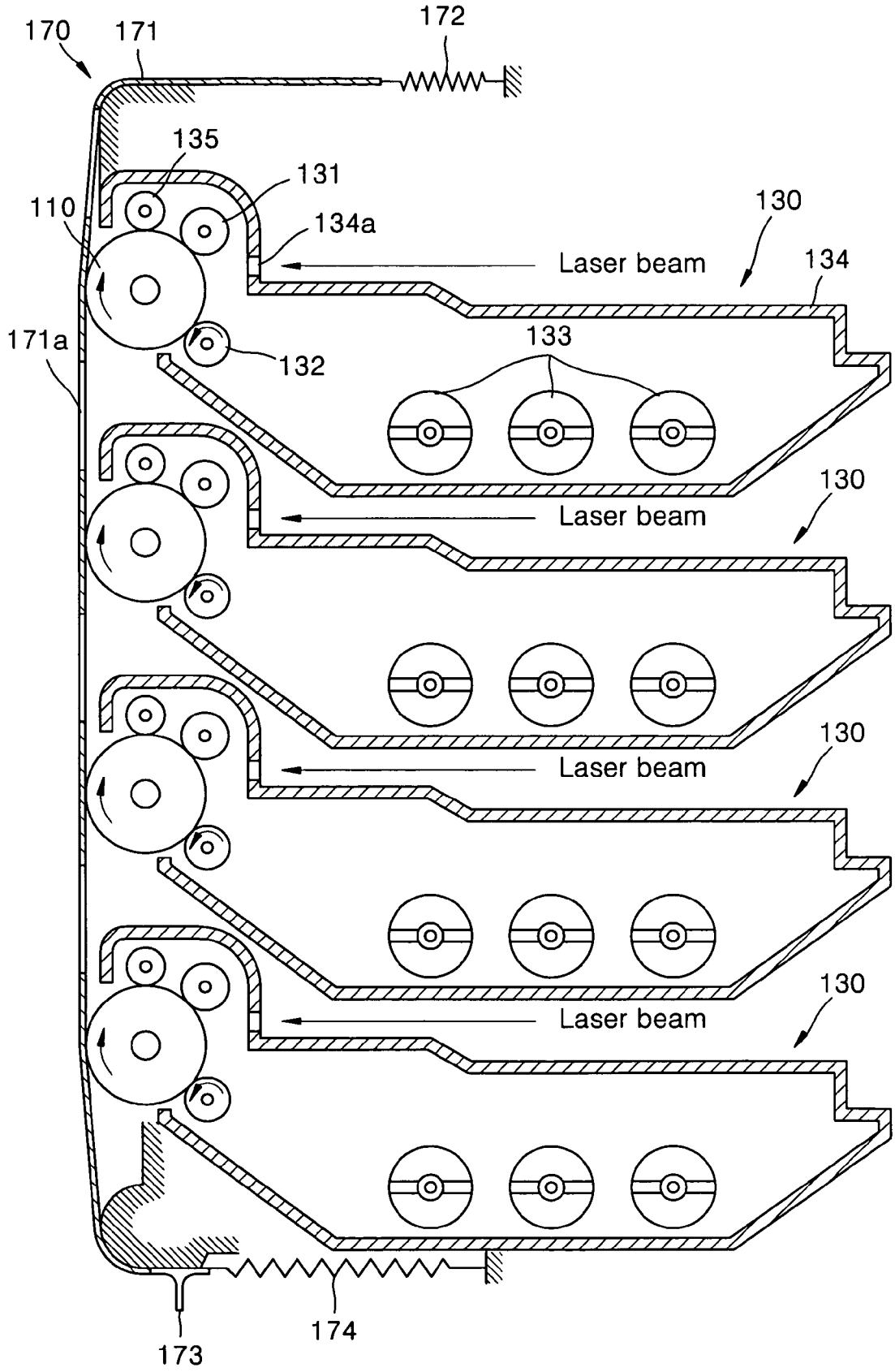
FIG. 5 is a cross-sectional view of developing device cartridges of the apparatus shown in FIG. 3, wherein photosensitive drum protecting devices are in a closed state.

FIG. 4 is a cross-section of developing device cartridges of the apparatus shown in FIG. 3, wherein photosensitive drum protecting devices are in a open state. FIG. 5 is a cross-section of developing device cartridges of the apparatus shown in FIG. 3, wherein photosensitive drum protecting devices are in a closed state.

Referring to FIGS. 4 and 5, the developing device cartridges 130 including the photosensitive drums 110 are vertically arranged, photosensitive drum covers 171 including openings 171*a* are disposed at front-end portions of the developing device cartridges 130, and each opening 171*a* is installed to enable the corresponding photosensitive drum 110 to contact the paper on the printing path. An upper end of the photosensitive drum cover 171 is connected to a main body of the printer via a first spring 172, and a lower end of the photosensitive drum cover 171 is connected to a protrusion 173. The protrusion 173 is connected to a second spring 174 and movably connected to the printer main body. When the printer is operated or the printer main body is not opened, the second spring 174 is compressed by a unit (not shown) for pushing the protrusion 173 and the first spring 172 is extended. When the unit for pushing the protrusion 173 is released, the photosensitive drum cover 171 is moved upward by the recovery force of the first spring 172 and the second spring 174 to cover the front-end portion of the developing device cartridges 130 as shown in FIG. 5. In this way, the photosensitive drum cover 171 protects the surface of the photosensitive drum 110 from external light and dust. The opening 171*a* is shaped as a long hole appropriate for the photosensitive drum to protrude therethrough.

The photosensitive drum cover 171 is fabricated using flexible film, such as polycarbonate film, for example, and the openings 171*a* are formed at positions corresponding to the center of photosensitive drums 110.

Operation of the color printer according to the above-described embodiment of the present invention will now be described with reference to the accompanying drawings.

When the printer is performing a printing process or in a standby state, the protrusion 173 is pushed backward so that the photosensitive drum cover 171 is pushed a predetermined distance backward, enabling the photosensitive drums 110 to directly contact the printing path. Here, the first spring 172 is extended, and the second spring 174 is compressed. Since the openings 171*a* of the photosensitive drum cover 171 are positioned in front of the corresponding photosensitive drums 110, the image forming process of the photosensitive drums 110 is performed as if there was no photosensitive drum cover 171.

When the photosensitive drum 110 is charged by the charging roller 131 to a predetermined electric potential, the light scanning unit 120 scans the surface of the photosensitive drum 110 to form an electrostatic latent image. If the developing device cartridges 130 are arranged in the order shown in FIG. 3, yellow color is developed first. The developing roller 132 of yellow color develops the electrostatic latent image on the photosensitive drum 110 to form a yellow toner image on the photosensitive drum 110. The yellow toner image is transferred onto the paper (S) that enters the printing path as being laid on the paper feeding belt 140. The paper onto which the yellow image is transferred receives the toner images formed on the photosensitive drums 110 sequentially. Therefore, toner images of four colors are overlapped on the paper when it passes by the photosensitive drums 110. The paper with the toner images is heated and pressed by the fuser 150 to fuse the images on the paper. The paper on which the toner images are fused is then discharged from the printer.

If the printer main body is opened to change the developing device cartridge 130 or fix a paper jam on the paper feeding path, the protrusion 173 is released and the first spring 172 and the second spring 174 are returned to their original positions. Accordingly, the photosensitive drum cover 171 connected to the springs 172 and 174 moves upward and the openings 171*a* are positioned between the photosensitive drums 110. In this case, a front surface of the photosensitive drums 110 is protected from external light and dust by the photosensitive drum cover 171.

In the embodiment described above, the protrusion 173 is installed at the lower portion of the photosensitive drum cover 171. However, in alternative embodiments, the protrusion 173 may be disposed at the upper portion of the photosensitive drum cover 171, or any other suitable portion of the photosensitive drum cover 171.

Also, in the embodiment described above, the device for protecting the photosensitive drum is used in the developing device cartridge 130 including the photosensitive drum 110 at the front end portion thereof. However, the photosensitive drum protecting device can be used in a case where photosensitive drums are vertically arranged and corresponding respective developing devices are installed at one side of the photosensitive drums.

In the color electrophotographic printer according to embodiments of the present invention, since all of the photosensitive drums that are disposed at the front portions of the developing device cartridges vertically arranged can be covered by one photosensitive drum protecting device, the number of elements in the printer can be reduced, and the printer can be made more compact.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A color electrophotographic printer, in which a plurality of photosensitive drums and developing devices are installed side by side and a printing path contacting the photosensitive drums is formed, the printer comprising:

a photosensitive drum protecting device that simultaneously exposes or protects each of the photosensitive drums;

wherein the photosensitive drum protecting device comprises a photosensitive drum cover including a plurality of elongated openings that expose the photosensitive drums.

2. A color electrophotographic printer, in which a plurality of developing device cartridges including photosensitive drums and developing rollers are installed, and a printing path contacting the photosensitive drums is formed, the printer comprising:

a photosensitive drum protecting device that simultaneously exposes or protects each of the photosensitive drums;

wherein the photosensitive drum protecting device comprises a photosensitive drum cover including a plurality of elongated openings through which the photosensitive drums are exposed.

3. A color electrophotographic printer, in which a plurality of developing device cartridges including photosensitive drums and developing rollers are installed, and a printing path contacting the photosensitive drums is formed, the printer comprising:

a photosensitive drum protecting device that simultaneously exposes or protects each of the photosensitive drums;

wherein the photosensitive drum protecting device comprises:

a photosensitive drum cover including a plurality of elongated openings through which the photosensitive drums are exposed;

a first elastic member that supports an upper portion of the photosensitive drum cover;

a second elastic member that supports a lower portion of the photosensitive drum cover; and a protrusion that is installed between the photosensitive drum cover and one of the first elastic member or the second elastic member, in order to move the photosensitive drum cover along the printing path due to displacement of the protrusion.

4. The printer of claim 3, wherein the photosensitive drum cover is fabricated using a flexible film.

5. The printer of claim 3, wherein the photosensitive drum cover is fabricated using a polycarbonate film.

6. The printer of claim 3, wherein when the protrusion is moved to a direction, the photosensitive drums protrude from the elongated openings of the photosensitive drum cover to form a contact portion between the photosensitive drums and the printing path, and when the protrusion is moved to an original position, the photosensitive drum cover blocks the contact portion.

7. A color electrophotographic printer, in which a plurality of photosensitive drums and developing devices are installed side by side and a printing path contacting the photosensitive drums is formed, the printer comprising:

a photosensitive drum protecting device that simultaneously exposes or protects each of the photosensitive drums;

wherein the photosensitive drum protecting device comprises:

a photosensitive drum cover including a plurality of elongated openings that expose the photosensitive drums;

a first elastic member that supports an upper portion of the photosensitive drum cover;

a second elastic member that supports a lower portion of the photosensitive drum cover; and a protrusion that is installed between the photosensitive drum cover and one of the first elastic member or the second elastic member, in order to move the photosensitive drum cover by an external force applied to the protrusion.

8. The printer of claim 7, wherein the photosensitive drum cover is fabricated using a flexible film.

9. The printer of claim 7, wherein the photosensitive drum cover is fabricated using a polycarbonate film.

10. The printer of claim 7, wherein when the protrusion is moved to a direction, the photosensitive drums protrude from the elongated openings of the photosensitive drum cover to form a contact portion between the photosensitive drums and printing path, and when the protrusion is moved to an original position, the photosensitive drum cover blocks the contact portion.

11. A method of operating an electrophotographic printer having a plurality of photosensitive drums and developing devices installed in a printing path, comprising the steps of:

installing a photosensitive drum protecting device in said printer, said photosensitive drum protecting device comprising a photosensitive drum cover having a plurality of elongated openings corresponding to the plurality of photosensitive drums;

moving said photosensitive drum protecting device to a first position, in which the photosensitive drums are exposed; and moving said photosensitive drum protecting device to a second position, in which the photosensitive drums are protected.

12. The method of claim 11, wherein said photosensitive drum cover comprises a flexible film.

13. The method of claim 11, wherein said photosensitive drum cover comprises a polycarbonate film.

14. A method of operating an electrophotographic printer having a plurality of photosensitive drums and developing devices installed in a printing path, comprising the steps of:

installing a photosensitive drum protecting device in said printer, said photosensitive drum protecting device comprising a photosensitive drum cover having a plurality of elongated openings corresponding to the plurality of photosensitive drums;

moving said photosensitive drum protecting device to a first position, in which the photosensitive drums are exposed; and moving said photosensitive drum protecting device to a second position, in which the photosensitive drums are protected;

wherein the moving steps comprise moving a protrusion member installed between said photosensitive drum protecting device and either of a first elastic member or a second elastic member.

* * * * *